US008800989B2

(12) United States Patent
Minowa

(10) Patent No.: US 8,800,989 B2
(45) Date of Patent: Aug. 12, 2014

(54) PAPER CONVEYING DEVICE

(71) Applicant: Riso Kagaku Corporation, Tokyo (JP)

(72) Inventor: Yousuke Minowa, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/030,989

(22) Filed: Sep. 18, 2013

(65) Prior Publication Data

US 2014/0077450 A1 Mar. 20, 2014

(30) Foreign Application Priority Data

Sep. 20, 2012 (JP) ..... 2012-206538

(51) Int. Cl.
*B65H 7/06* (2006.01)
*G03G 15/00* (2006.01)

(52) U.S. Cl.
CPC . *B65H 7/06* (2013.01); *G03G 15/70* (2013.01)
USPC ..... 271/258.01; 271/259; 271/258.04; 399/21

(58) Field of Classification Search
CPC ..... B65H 7/06; G03G 15/70
USPC ..... 271/258.01, 259, 258.04, 258.03; 399/21
See application file for complete search history.

(56) References Cited

U.S. PATENT DOCUMENTS 7,127,184 B2 * 10/2006 Coriale et al. ..... 399/21

FOREIGN PATENT DOCUMENTS

EP 2169469 A1 3/2010
JP 02138049 A * 5/1990

* cited by examiner

*Primary Examiner* — Luis A Gonzalez
(74) *Attorney, Agent, or Firm* — Studebaker & Brackett PC

(57) ABSTRACT

A paper conveying device includes: a conveyance path, along which paper is conveyed; paper jam removal zones provided side by side along the conveyance path; paper detection sensors respectively provided in the paper jam removal zones for detecting the presence or absence of paper; a paper jam detecting section for detecting paper jam based on output signals from the paper detection sensors; a signal storing section for storing previous signal statuses just before current signal statuses of the output signals of the paper detection sensors; a display section for displaying one of the paper jam removal zones; and a display controlling section for identifying the one of the paper jam removal zones based on the current signal statuses and the previous signal statuses of the paper detection sensors when paper jam is detected, and displaying the identified paper jam removal zone on the display section.

3 Claims, 4 Drawing Sheets

T2

| CURRENT SIGNAL STATUS | | PREVIOUS SIGNAL STATUS | | PAPER JAM REMOVAL ZONE |
|---|---|---|---|---|
| S2 | S3 | S2 | S3 | |
| on | on | on | off | C |
| | | off | on | B |
| on | off | NOT TAKEN INTO ACCOUNT | NOT TAKEN INTO ACCOUNT | B |
| off | on | NOT TAKEN INTO ACCOUNT | NOT TAKEN INTO ACCOUNT | C |

FIG.3
T1
| CURRENT SIGNAL STATUS | | PREVIOUS SIGNAL STATUS | | PAPER JAM REMOVAL ZONE |
|---|---|---|---|---|
| S1 | S2 | S1 | S2 | |
| on | on | NOT TAKEN INTO ACCOUNT | NOT TAKEN INTO ACCOUNT | A |
| on | off | NOT TAKEN INTO ACCOUNT | NOT TAKEN INTO ACCOUNT | A |
| off | on | on | NOT TAKEN INTO ACCOUNT | A(→B) |
| | | off | NOT TAKEN INTO ACCOUNT | B |
FIG.4
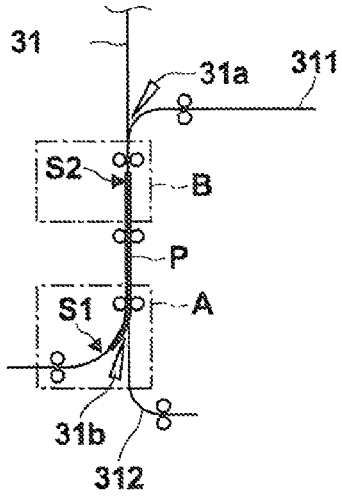
FIG.5
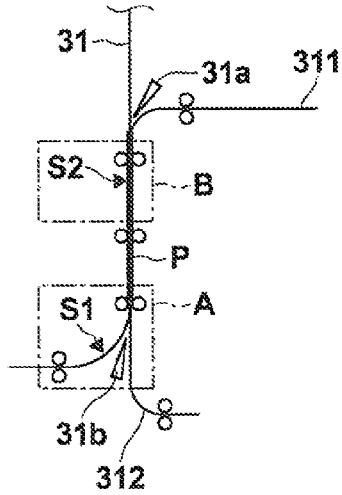

FIG.6
T2
| CURRENT SIGNAL STATUS | | PREVIOUS SIGNAL STATUS | | PAPER JAM REMOVAL ZONE |
|---|---|---|---|---|
| S2 | S3 | S2 | S3 | |
| on | on | on | off | C |
| | | off | on | B |
| on | off | NOT TAKEN INTO ACCOUNT | NOT TAKEN INTO ACCOUNT | B |
| off | on | NOT TAKEN INTO ACCOUNT | NOT TAKEN INTO ACCOUNT | C |
FIG.7
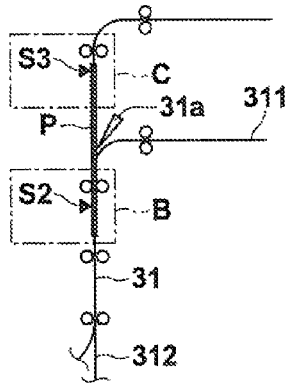
FIG.8
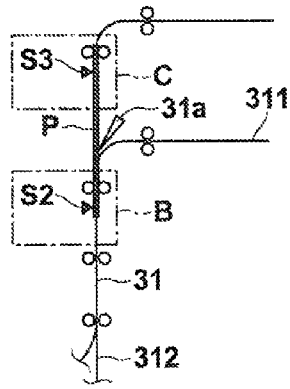

PAPER CONVEYING DEVICE

BACKGROUND OF THE INVENTION

1. Field of the Invention

The present invention relates to a paper conveying device, where occurrence of paper jam in a conveyance path during conveyance of paper is detected, and information about a removal position for removing jammed paper is displayed.

2. Description of the Related Art

Printers, bookbinding machines, etc., in general, include a paper conveying device formed by various rollers, etc., for conveying paper sheets, where paper sheets placed on a tray, or the like, are conveyed along a predetermined conveyance path by the paper conveying device. Then, various operations, such as printing, binding, etc., are performed on the paper sheets at predetermined positions in the course of conveyance.

With such devices, paper jam may occur due to some cause while paper sheets are conveyed along a conveyance path, and this hinders normal conveyance of paper sheets. Therefore, techniques are known, where paper jam detection sensors are disposed at points along a conveyance path, and when paper jam is detected, a guidance to remove the paper jam is displayed on a display section.

For example, European Patent Application Publication No. 2169469 discloses a paper conveying device, wherein paper jam detection is performed based on ON/OFF statuses and temporal changes thereof of a plurality of paper detection sensors disposed along a conveyance path, and when paper jam is detected, a removal position for removing jammed paper is determined based on the ON/OFF statuses of the paper detection sensors at the point of time when the paper jam is detected and information about the removal position is displayed as an error message on a display section.

SUMMARY OF THE INVENTION

However, with the above-described conventional paper conveying devices, where the removal position for removing jammed paper is determined based only on the signal statuses at the point of time when the paper jam is detected by the paper detection sensors, determination and display of an appropriate removal position for removing jammed paper may not be achieved depending on the arrangement of the paper detection sensors and the arrangement of the removal position for removing jammed paper. For example, in the case, as shown in FIG. 4, where two paper jam removal zones A and B are provided along a conveyance path 31 that extends in the vertical direction as a whole and includes a curved portion that curves to the left at the lower portion thereof, and paper detection sensors S1 and S2 are provided respectively in the paper jam removal zones, when jam occurs and conveyance of a paper sheet P is stopped in the state shown in the drawing, the jam is detected in a state where the paper detection sensor S1 is OFF and the paper detection sensor S2 is ON. Therefore, according to the above-described conventional paper conveying devices, the paper jam removal zone B corresponding to the paper detection sensor S2, by which paper is detected at the point of time when the jam is detected, is displayed as the removal position for removing the jammed paper P. In the case shown in FIG. 4, however, part of the paper sheet P is on the curved portion of the conveyance path 31, and it is easier to remove the jammed paper P from the paper jam removal zone A, which includes the curved portion, than from the paper jam removal zone B. Therefore, it is more appropriate to display the paper jam removal zone A as the removal position for removing jammed paper.

Further, in the case, as shown in FIGS. 7 and 8, where two paper jam removal zones B and C are provided side by side along the conveyance path 31 that linearly extends in the vertical direction, and paper detection sensors S2 and S3 are respectively provided in the paper jam removal zones, when jam occurs and conveyance of a paper sheet P is stopped in the state shown in the drawing, the jam is detected in a state where both the paper detection sensors S2 and S3 are ON. Therefore, according to the above-described conventional paper conveying devices, both the paper jam removal zones B and C corresponding to the paper detection sensors S2 and S3, by which paper is detected at the point of time when the jam is detected, are displayed as the removal positions for removing the jammed paper P. In the case shown in FIG. 7, however, the paper sheet P is stopped at a position nearer to the paper jam removal zone B, and it is more appropriate to display the paper jam removal zone B as the removal position for removing the jammed paper P. In the case shown in FIG. 8, the paper sheet P is stopped at a position nearer to the paper jam removal zone C, and it is more appropriate to display the paper jam removal zone C as the removal position for removing the jammed paper P.

In order to display a more appropriate removal position for removing jammed paper, one may consider increasing the number of paper detection sensors to allow finer detection of the position of jammed paper. This approach, however, leads to cost increase due to the increase of the number of paper detection sensors.

In view of the above-described circumstances, the present invention is directed to providing a paper conveying device that can provide a more appropriate removal position for removing jammed paper without increasing the number of paper detection sensors.

An aspect of the paper conveying device of the invention is a paper conveying device including: a conveyance path, along which paper is conveyed; a plurality of paper jam removal zones for removing jammed paper provided side by side along the conveyance path; a plurality of paper detection sensors respectively provided in the paper jam removal zones for detecting the presence or absence of paper at the position of each paper detection sensor; paper jam detecting means for detecting paper jam based on output signals from the paper detection sensors; signal storing means for storing previous signal statuses just before current signal statuses of the output signals of the paper detection sensors; a display section for displaying one of the paper jam removal zones for removing the paper jam; and display controlling means for identifying one of the paper jam removal zones based on a combination of the current signal statuses obtained from the paper detection sensors and the previous signal statuses stored in the signal storing means when paper jam is detected by the paper jam detecting means and displaying the identified paper jam removal zone on the display section. The number of the paper jams removal zones and the paper detection sensors may be two or three or more, respectively.

It should be noted that the paper conveying device of the invention does not always perform the above-described display control based on the current signal statuses and the previous signal statuses every time paper jam is detected. The paper conveying device performs the above-described display control based on the current signal statuses and the previous signal statuses only if the current signal statuses of the paper detection sensors at the point of time when paper jam is detected are in one of specific conditions set in advance.

The paper conveying device of the invention may be configured such that the paper jam removal zones are two paper jam removal zones, the paper detection sensors are two paper detection sensors, and if the presence of paper is detected by both the two paper detection sensors at the point of time when paper jam is detected by the paper jam detecting means, then the display controlling means displays, on the display section, the paper jam removal zone provided with the paper detection sensor that has the previous signal status indicating the absence of paper.

The paper conveying device of the invention may be configured such that the paper jam removal zones are two paper jam removal zones, the paper detection sensors are two paper detection sensors, the conveyance path includes a curved portion only in one of the two paper jam removal zones, and if the presence of paper is detected only by the paper detection sensor in the other of the two paper jam removal zones at the point of time when paper jam is detected by the paper jam detecting means, then the display controlling means displays the one of the two paper jam removal zones on the display section if the paper detection sensor in the one of the two paper jam removal zones has the previous signal status indicating the presence of paper, or displays the other of the two paper jam removal zones on the display section if the paper detection sensor in the one of the two paper jam removal zones has the previous signal status indicating the absence of paper.

According to the paper conveying device of the invention, which includes: a conveyance path, along which paper is conveyed; a plurality of paper jam removal zones for removing jammed paper provided side by side along the conveyance path; a plurality of paper detection sensors respectively provided in the paper jam removal zones for detecting the presence or absence of paper at the position of each paper detection sensor; paper jam detecting means for detecting paper jam based on output signals from the paper detection sensors; signal storing means for storing previous signal statuses just before current signal statuses of the output signals of the paper detection sensors; a display section for displaying one of the paper jam removal zones for removing the paper jam; and display controlling means for identifying one of the paper jam removal zones based on a combination of the current signal statuses obtained from the paper detection sensors and the previous signal statuses stored in the signal storing means when paper jam is detected by the paper jam detecting means and displaying the identified paper jam removal zone on the display section, a paper jam removal zone to be the removal position for removing jammed paper when paper jam is detected is determined based not only on the current signal statuses obtained from the paper detection sensors but also on the previous signal statuses just before the current signal statuses of the paper detection sensors. This allows displaying a more appropriate removal position for removing jammed paper than that provided by conventional paper conveying devices where the removal position for removing jammed paper is determined based only on the current signal statuses of paper detection sensors.

In the case where the paper conveying device of the invention is configure such that the paper jam removal zones are two paper jam removal zones, the paper detection sensors are two paper detection sensors, and if the presence of paper is detected by both the two paper detection sensors at the point of time when paper jam is detected by the paper jam detecting means, then the display controlling means displays, on the display section, the paper jam removal zone provided with the paper detection sensor that has the previous signal status indicating the absence of paper, an appropriate removal position for removing jammed paper can be displayed, as described below, in the cases as shown in FIGS. 7 and 8.

In general, when paper being conveyed is stopped due to occurrence of paper jam, the paper tends to stop after advancing slightly downstream due to inertia. When paper jam is detected in a state where both paper detection sensors S2 and S3 are ON (i.e., the presence of paper is detected), as shown in FIGS. 7 and 8, the paper sheet P stops in a state as shown in FIG. 7 if the paper sheet P is being conveyed downward from the upper portion of a conveyance path 31, and the paper sheet P stops in a state as shown in FIG. 8 if the paper sheet P is being conveyed upward from the lower portion of the conveyance path 31. Focusing on this fact, the paper conveying device of the invention is configured such that, when both the output signals from the paper detection sensors S2 and S3 at the point of time when paper jam is detected are ON, the paper jam removal zone with the previous signal status of the paper detection sensor, just before the current signal status, being OFF (the absence of paper is detected) (i.e., the paper jam removal zone on the downstream side in the conveyance direction) is determined as the removal position for removing jammed paper. Therefore, in the case shown in FIG. 7 where the previous signal status of the paper detection sensor S2 is OFF and the previous signal status of the paper detection sensor S3 is ON, the paper jam removal zone B, which is deemed to be the most appropriate removal position for removing the jammed paper P in this case, can be displayed as the removal position for removing the jammed paper P. On the other hand, in the case shown in FIG. 8 where the previous signal status of the paper detection sensor S2 is ON and the previous signal status of the paper detection sensor S3 is OFF, the paper jam removal zone C, which is deemed to be the most appropriate removal position for removing the jammed paper P in this case, can be displayed as the removal position for removing the jammed paper P.

In the case where the paper conveying device of the invention is configure such that the paper jam removal zones are two paper jam removal zones, the paper detection sensors are two paper detection sensors, the conveyance path includes a curved portion only in one of the two paper jam removal zones, and if the presence of paper is detected only by the paper detection sensor in the other of the two paper jam removal zones at the point of time when paper jam is detected by the paper jam detecting means, then the display controlling means displays the one of the two paper jam removal zones on the display section if the paper detection sensor in the one of the two paper jam removal zones has the previous signal status indicating the presence of paper, or displays the other of the two paper jam removal zones on the display section if the paper detection sensor in the one of the two paper jam removal zones has the previous signal status indicating the absence of paper, an appropriate removal position for removing jammed paper can be displayed in the case as shown in FIG. 4, for example. Namely, in the case shown in FIG. 4, where the paper sheet P being conveyed along the conveyance path 31, in particular, being conveyed upward through the curved portion at the lower portion is jammed and the conveyance of the paper sheet P is stopped in the state shown in the drawing, a paper jam removal zone A, which is deemed to be the most appropriate removal position for removing the jammed paper P in this case, can be displayed as the removal position for removing the jammed paper P based on the fact that the previous output signal of a paper detection sensor S1 provided at the curved portion is ON, even if the output signal from the paper detection sensor S1 at the point of time when paper jam is detected is OFF.

BRIEF DESCRIPTION OF THE DRAWINGS

FIG. 3 illustrates an example of a table showing a correspondence relationship between signal statuses of paper detection sensors and paper jam removal zones, FIG. 4 is a diagram illustrating a state where paper being conveyed is jammed (case 1), FIG. 5 is a diagram illustrating another state where paper being conveyed is jammed (case 1), FIG. 6 is a an example of a table showing a correspondence relationship between signal statuses of paper detection sensors and paper jam removal zones, FIG. 7 is a diagram illustrating a state where paper being conveyed is jammed (case 2), and FIG. 8 is a diagram illustrating another state where paper being conveyed is jammed (case 2).

DESCRIPTION OF THE PREFERRED EMBODIMENTS

Hereinafter, one embodiment of paper conveying device of the present invention will be described with reference to the drawings.

Figure 1:
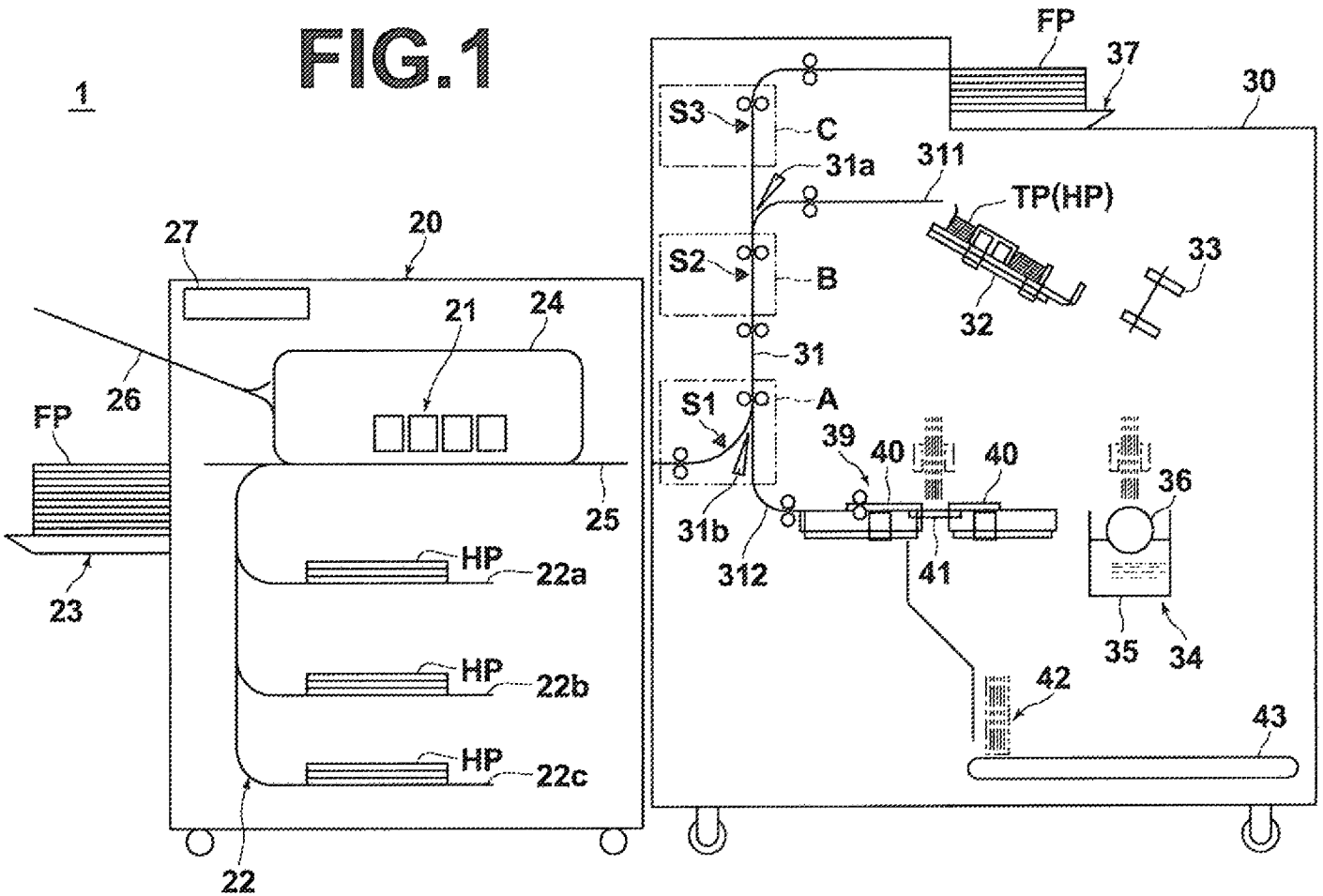
FIG. 1 illustrates the schematic structure of the entire printing system.

FIG. 1 is a diagram illustrating the schematic structure of a printing system 1, to which a paper conveying device of the invention is applied. As shown in FIG. 1, the printing system 1 includes a printing unit 20, which performs printing on printing paper sheets for covers and printing paper sheets for pages used for case binding, and a bookbinding unit 30, which performs case binding using the printing paper sheets subjected to printing at the printing unit 20.

The printing unit 20 includes an ink head section 21, which ejects ink onto the printing paper sheets. The ink head section 21 achieves printing by ejecting ink onto the printing paper sheets based on image data of pages and a cover inputted to the printing unit 20. The ink head section 21 of this embodiment includes a plurality of line-type ink heads for ejecting inks of different colors, such as black K, cyan C, magenta M and yellow Y.

The printing unit 20 also includes a paper feeding tray 22, on which printing paper sheets HP for pages are placed, and a straight paper feeding tray 23, on which printing paper sheets FP for covers are placed. The paper feeding tray 22 includes a first paper feeding tray 22*a*, a second paper feeding tray 22*b* and a third paper feeding tray 22*c* for holding the printing paper sheets HP for pages of different types and/or sizes. During production of case-bound books, the printing paper sheets FP for covers and the printing paper sheets HP for pages are picked up and fed one by one by paper feeding rollers, or the like, from the straight paper feeding tray 23 and the paper feeding tray 22, respectively.

The printing unit 20 includes a circulating conveyance path 24 for conveying the printing paper sheets FP for covers and the printing paper sheets HP for pages. The circulating conveyance path 24 conveys the printing paper sheets FP for covers, which are fed from the straight paper feeding tray 23, and the printing paper sheets HP for pages, which are fed from the paper feeding tray 22, from the upstream side to the downstream side of the ink head section 21.

In the case of simplex printing, the circulating conveyance path 24 passes the printing paper sheets subjected to printing at the ink head section 21 to a connecting conveyance path 25. In the case of duplex printing, the circulating conveyance path 24 conveys the printing paper sheets with one faces thereof subjected to printing to an inverting section 26, and conveys the printing paper sheets which are inverted at the inverting section 26 again from the upstream side to the downstream side of the ink head section 21. Thereafter, the circulating conveyance path 24 passes the printing paper sheets with the other faces thereof subjected to printing at the ink head section 21 (and thus the opposite faces thereof subjected to printing) to the connecting conveyance path 25. Then, the printed printing paper sheets received by the connecting conveyance path 25 are fed to the bookbinding unit 30.

The printing unit 20 also includes a touch panel 27, which displays predetermined setting input screens and receives predetermined inputs of setting by the user. The touch panel 27 in this embodiment presents to the user information about a removal position for removing jammed paper when, for example, paper jam occurs at the bookbinding unit 30 and conveyance of the printing paper sheets is stopped. How the information about the removal position for removing jammed paper is displayed will be described in detail later.

The bookbinding unit 30 includes a conveyance path 31 for receiving and conveying the printing paper sheets FP for covers and the printing paper sheets HP for pages fed from the connecting conveyance path 25 of the printing unit 20. To the conveyance path 31, a branched conveyance path 311 that leads to an aligning tray 32 and a branched conveyance path 312 that leads to a shaping section 39 are connected, and a switching mechanism 31*a*, 31*b* for switching the paper conveyance direction is provided in the vicinity of the connecting position (branching position) of each branched conveyance path 311, 312.

With this configuration, each printing paper sheet HP for page received by the conveyance path 31 is conveyed upward through a curved portion in the vicinity of a paper receiving position, and is passed to the branched conveyance path 311 by the switching mechanism 31*a* at the branching position of the branched conveyance path 311 to be further conveyed along the branched conveyance path 311 and fed to the aligning tray 32. On the other hand, each printing paper sheet FP for cover received by the conveyance path 31 is conveyed upward through the curved portion in the vicinity of the paper receiving position, and when the leading edge of the printing paper sheet FP for cover has passed the branching position of the branched conveyance path 311, the conveyance direction is inverted and the printing paper sheet FP for cover is conveyed downward. Then, the printing paper sheet FP for cover is passed to the branched conveyance path 312 by the switching mechanism 31*b* at the branching position of the branched conveyance path 312 to be further conveyed along the branched conveyance path 312 and fed to the shaping section 39.

The bookbinding unit 30 includes a paper feeding table 37, on which the printing paper sheets FP for covers are placed. The bookbinding unit 30 can receive the printing paper sheets FP for covers from the paper feeding table 37, in place of receiving the printing paper sheets FP for covers from the printing unit 20. Each printing paper sheet FP for cover fed from the paper feeding table 37 is conveyed downward along the conveyance path 31, and passed to the branched conveyance path 312 by the switching mechanism 31*b* at the branching position of the branched conveyance path 312 to be further conveyed along the branched conveyance path 312 and fed to the shaping section 39.

As shown in FIG. 1, the bookbinding unit 30 includes, along the conveyance path 31, three paper jam removal zones A, B and C for removing jammed paper, and three paper detection sensors S1, S2 and S3 for detecting the presence or absence of paper the position of each paper detection sensor are respectively provided in the paper jam removal zones A, B and C. In each paper jam removal zone A, B, C, structures used to remove paper jam, such as an openable cover for exposing the conveyance path in each zone and an operation lever for separating pressing surfaces of rollers of a conveyance roller pair for nipping and conveying a paper sheet from each other, are provided.

The printing paper sheets HP for pages conveyed by the paper conveyance path 311 are sequentially stacked on the aligning tray 32. The bookbinding unit 30 includes a clamper 33 for receiving and clamping a bundle TP of the printing paper sheets HP for pages from the aligning tray 32. The clamper 33 is adapted to be movable by a moving mechanism (not shown) between a bundle receiving position, where the clamper 33 receives the bundle TP from the aligning tray 32, and a binding position, where the clamper 33 passes the bundle TP to the shaping section 39. A gluing section 34 is disposed in the vicinity of the clamper 33. The gluing section 34 includes: a glue storing vessel 35 for storing a glue, which is used to adhere the bundle TP to the printing paper sheet FP for cover; and a glue application roller 36 for applying the glue to the bundle TP. The glue application roller 36 has an elongated shape, and is rotatably held within the glue storing vessel 35 by a horizontal rotating shaft.

The shaping section 39 includes a cover folding plate 40 and an abutting plate 41 disposed below the cover folding plate 40. Each printing paper sheet FP for cover conveyed by the paper conveyance path 312 is placed on the top surface of the cover folding plate 40, and the spine of each bundle TP conveyed by the clamper 33 to the binding position is abutted on the abutting plate 41 via the printing paper sheet FP for cover. The bookbinding unit 30 also includes an output section 43. Each book 42, which has been bound and shaped at the shaping section 39, is conveyed to and placed at the output section 43.

Next, a control system of the printing system 1 of this embodiment is described with reference to FIG. 2. It should be noted that the printing system 1 of this embodiment is characterized by display control about the removal position for removing jammed paper, and therefore the control system relating to this feature is mainly described.

Figure 2:
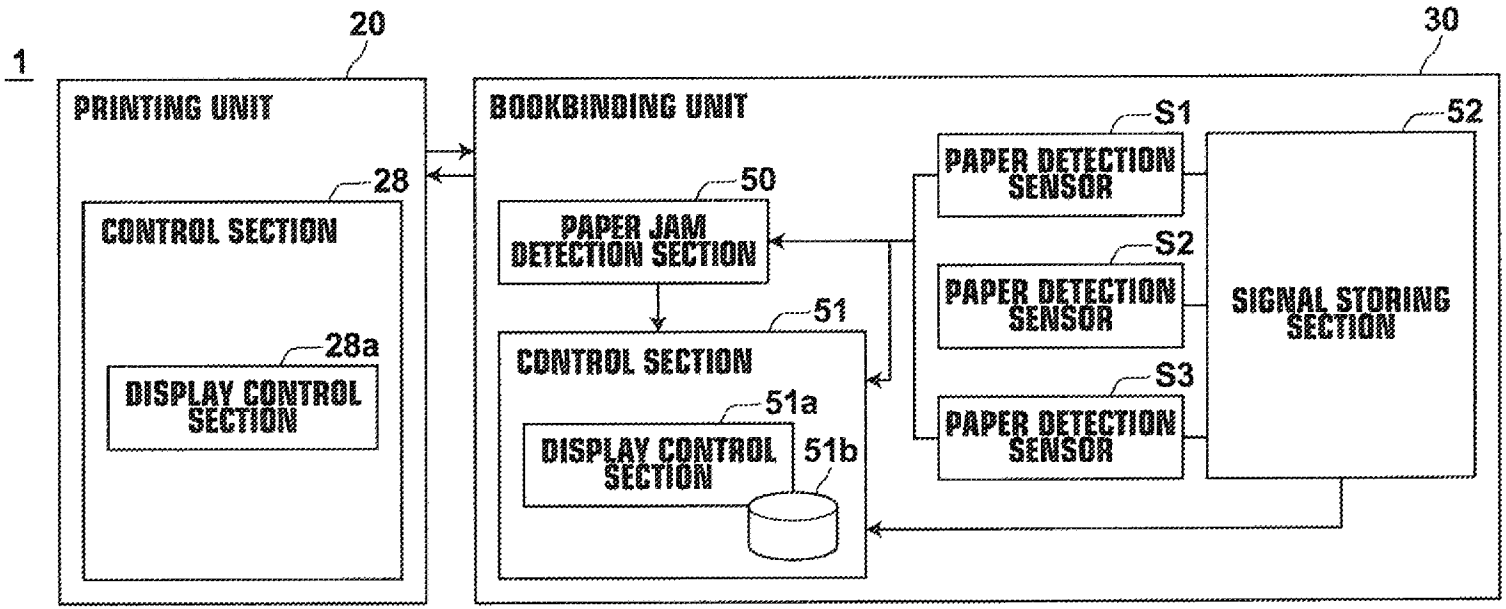
FIG. 2 is a block diagram illustrating the configuration of a control system of the printing system.

As shown in FIG. 2, the printing unit 20 includes a control section 28 for controlling the entire printing unit 20. When paper jam is detected at the bookbinding unit 30, the control section 28 suspends the printing operation of the printing unit 20 along with the suspension of the operation of the bookbinding unit 30. The control section 28 includes a display control section 28*a*. When paper jam is detected at the bookbinding unit 30, as described above, the display control section 28*a* receives information of the paper jam removal zone from the bookbinding unit 30 as the removal position for removing jammed paper, and displays, on the touch panel 27, a screen for prompting the user to remove jammed paper from the paper jam removal zone. As the screen for prompting the user to remove jammed paper from a specific paper jam removal zone, for example, a screen displaying an image showing the position of the paper jam removal zone, and/or a screen displaying a message for prompting the user to remove jammed paper may be displayed.

As shown in FIG. 2, the bookbinding unit 30 includes a control section 51 for controlling the entire bookbinding unit 30. The bookbinding unit 30 also includes: a paper jam detection section 50 for detecting paper jam in the bookbinding unit 30 based on output signals from the paper detection sensors S1, S2 and S3; and a signal storing section 52 for storing previous signal statuses just before the current signal statuses of the output signals of the paper detection sensors S1, S2 and S3. When paper jam is detected by the paper jam detection section 50, a paper jam detection signal is inputted to the control section 51. Then, the control section 51 suspends the binding operation of the bookbinding unit 30 in response to the paper jam detection signal.

The control section 51 includes a display control section 51*a*. When paper jam is detected by the paper jam detection section 50, the display control section 51*a* identifies a paper jam removal zone to be the removal position for removing jammed paper based on a combination of the current signal statuses obtained from two paper detection sensors S1 and S2 (or S2 and S3) disposed side by side and the previous signal statuses of the sensors stored in the signal storing section 52, and outputs information identifying the paper jam removal zone to the printing unit 20.

If one or both of the output signals from the two paper detection sensors S1 and S2 disposed side by side is abnormal, occurrence of paper jam is detected, and the display control section 51*a* obtains the current signal statuses from the paper detection sensors S1 and S2 and obtains the previous signal statuses of the paper detection sensors S1 and S2 from the signal storing section 52. Then, the display control section 51*a* references a table T1, as shown in FIG. 3, which is set and stored in advance in a built-in memory 51*b*, to identify a paper jam removal zone associated with the combination of the current signal statuses and the previous signal statuses of the paper detection sensors S1 and S2, and outputs the information identifying the paper jam removal zone to the printing unit 20.

As shown in FIG. 1, the paper jam removal zone A includes a curved portion of the conveyance path 31. Therefore, not only when the jammed paper P is only in the paper jam removal zone A but also when the jammed paper P is in both the paper jam removal zones A and B, it is easier to remove the jammed paper P from the paper jam removal zone A than from the paper jam removal zone B. Therefore, in the table T1, all the combinations of signal statuses where the (current) output signal of the paper detection sensor S1 at the point of time when paper jam is detected is ON are associated with the paper jam removal zone A, and the combination of signal statuses where the current output signal of the paper detection sensor S1 is OFF and the previous output signal of the paper detection sensor S1 is ON is also associated with the paper jam removal zone A. On the other hand, the combination of signal statuses where the current output signal of the paper detection sensor S1 is OFF, the current output signal of paper detection sensor S2 is ON, and the previous output signal of the paper detection sensor S1 is OFF is associated with the paper jam removal zone B.

Therefore, when a paper sheet P being conveyed upward along the conveyance path 31 through the lower curved portion is jammed, as shown in FIG. 4, and the conveyance of the paper sheet P is stopped in the state shown in the drawing, the display control section 51*a* identifies the paper jam removal zone A as the removal position for removing the jammed paper P since the current output signal of the paper detection sensor S1 is OFF, the current output signal of the paper detection sensor S2 is ON and the previous output signal of the paper detection sensor S1 is ON. When the paper sheet P being conveyed downward along the conveyance path 31 is jammed, as shown in FIG. 5, and the conveyance of the paper sheet P is stopped in the state shown in the drawing, the display control section 51*a* identifies the paper jam removal zone B as the removal position for removing the jammed paper P since the current output signal of the paper detection sensor S1 is OFF, the current output signal of the paper detection sensor S2 is ON, and the previous output signal of the paper detection sensor S1 is OFF. Then, the display control section 51*a* outputs information of the identified paper jam removal zone to the printing unit 20, and the display control section 28*a* of the printing unit 20 receives the information of the paper jam removal zone and displays, on the touch panel 27, a screen for prompting the user to remove jammed paper from the paper jam removal zone. It should be noted that, in this embodiment, the display control section 28*a* of the printing unit 20 and the display control section 51*a* of the bookbinding unit 30 as a whole correspond to display controlling means of the invention.

On the other hand, if one or both of the output signals from the two paper detection sensors S2 and S3 disposed side by side is abnormal, occurrence of paper jam is detected, and the display control section 51*a* obtains the current signal statuses from the paper detection sensors S2 and S3 and obtains the previous signal statuses of the paper detection sensors S2 and S3 from the signal storing section 52. Then, the display control section 51*a* references a table T2, as shown in FIG. 6, which is set and stored in advance in the built-in memory 51*b*, to identify a paper jam removal zone associated with the combination of the current signal statuses and the previous signal statuses of the paper detection sensors S2 and S3, and outputs the information identifying the paper jam removal zone to the printing unit 20.

In general, when paper being conveyed is stopped due to occurrence of paper jam, the paper tends to stop after advancing slightly downstream due to inertia, and it is easier to remove the jammed paper from a paper jam removal zone on the downstream side of the jammed paper than from a paper jam removal zone on the upstream side of the jammed paper. Therefore, in the table T2, the combinations of signal statuses where both the (current) output signals of the paper detection sensors S2 and S3 at the point of time when paper jam is detected are ON are associated with the paper jam removal zone with the previous signal status of the corresponding paper detection sensor being OFF (i.e., the paper jam removal zone on the downstream side in the conveyance direction), such that the combination of signal statuses where the current output signals of the paper detection sensors S2 and S3 are ON and the previous signal status of the paper detection sensor S2 is OFF is associated with the paper jam removal zone B, and the combination of signal statuses where the current output signals of the paper detection sensors S2 and S3 are ON and the previous signal status of the paper detection sensor S3 is OFF is associated with the paper jam removal zone C.

Further, the combination of signal statuses where the current signal status of the paper detection sensor S2 is ON and the current signal status of the paper detection sensor S3 is OFF is associated with the paper jam removal zone B, and the combination of signal statuses where the current signal status of the paper detection sensor S2 is OFF and the current signal status of the paper detection sensor S3 is ON is associated with the paper jam removal zone C.

Therefore, when the paper sheet P being conveyed downward along the conveyance path 31 is jammed, as shown in FIG. 7, and the conveyance of the paper sheet P is stopped in the state shown in the drawing, the display control section 51*a* identifies the paper jam removal zone B as the removal position for removing the jammed paper P since both the current output signals of the paper detection sensors S2 and S3 are ON, the previous output signal of the paper detection sensor S2 is OFF and the previous output signal of the paper detection sensor S3 is ON. When the paper sheet P being conveyed downward along the conveyance path 31 is jammed, as shown in FIG. 8, and the conveyance of the paper sheet P is stopped in the state shown in the drawing, the display control section 51*a* identifies the paper jam removal zone C as the removal position for removing the jammed paper P since both the current output signals of the paper detection sensors S2 and S3 are ON, the previous output signal of the paper detection sensor S2 is ON and the previous output signal of the paper detection sensor S3 is OFF. Then, the display control section 51*a* outputs information of the identified paper jam removal zone to the printing unit 20, and the display control section 28*a* of the printing unit 20 receives the information of the paper jam removal zone and displays, on the touch panel 27, a screen for prompting the user to remove jammed paper from the paper jam removal zone.

Next, operation of the printing system 1 of this embodiment is briefly described. Again, operation relating to the display control about the removal position for removing jammed paper at the printing unit 20 and the bookbinding unit 30 is mainly described. First, when paper jam occurs at the bookbinding unit 30 while the printing operation is performed at the printing unit 20 and the binding operation is performed at the bookbinding unit 30, the occurrence of paper jam is detected by the paper jam detection section 50 of the bookbinding unit 30. A detection signal of the paper jam detected by the paper jam detection section 50 is inputted to the control section 51 of the bookbinding unit 30. The control section 51 suspends the binding operation of the bookbinding unit 30 in response to the inputted detection signal, and outputs a signal to that effect to the control section 28 of the printing unit 20. Then, the control section 28 of the printing unit 20 suspends the printing operation, along with the suspension of the binding operation of the bookbinding unit 30.

Then, the display control section 51*a* of the bookbinding unit 30 identifies a paper jam removal zone to be the removal position for removing jammed paper based on the combination of the current signal statuses of the paper detection sensors S1 and S2 (or S2 and S3) and the previous signal statuses of the paper detection sensors S1 and S2 (or S2 and S3) stored in the signal storing section 52, and outputs information of the identified paper jam removal zone to the display control section 51*a* of the printing unit 20. The display control section 51*a* of the printing unit 20 receives the information of the paper jam removal zone fed from the bookbinding unit 30 and displays, on the touch panel 27, a screen for prompting the user to remove jammed paper from the paper jam removal zone.

As the paper jam in the bookbinding unit 30 is removed by the user seeing the display on the touch panel 27, the removal of paper jam is detected by the paper jam detection section 50, and a detection signal of the removal of paper jam is inputted to the control section 28 of the printing unit 20 and the control section 51 of the bookbinding unit 30. When preparation operations of both the printing unit 20 and the bookbinding unit 30 are completed, the printing operation of the printing unit 20 and the binding operation of the bookbinding unit 30 are restarted.

According to the above-described configuration of the printing system 1 of this embodiment, when paper jam is detected at the bookbinding unit 30, a paper jam removal zone to be the removal position for removing jammed paper is determined based not only on the current signal statuses obtained from the paper detection sensors S1 and S2 (or S2 and S3) but also on the previous signal statuses of the paper detection sensors S1 and S2 (or S2 and S3) just before the current signal statuses. This allows displaying a more appropriate removal position for removing jammed paper than that provided by conventional paper conveying devices where the removal position for removing jammed paper is determined based only on the current signal statuses of paper detection sensors.

While the paper conveying device of the present invention is applied to the printing system 1 in the above-described embodiment, this is not intended to limit the invention. The paper conveying device of the invention is also applicable to any other devices for handling paper sheets employing a paper conveyance structure, such as an enclosing/sealing machine. Further, while the paper conveying device of the invention is applied to the device configured to use two paper jam removal zones and two paper detection sensors in the above-described embodiment; this is not intended to limit the invention. The paper conveying device of the invention is also applicable to a device configured to use three or more paper jam removal zones and three or more paper detection sensors.

What is claimed is:

1. A paper conveying device comprising:

a conveyance path, along which paper is conveyed;

a plurality of paper jams removal zones for removing jammed paper provided side by side along the conveyance path;

a plurality of paper detection sensors respectively provided in the paper jam removal zones for detecting the presence or absence of paper at the position of each paper detection sensor;

paper jam detecting means for detecting paper jam based on output signals from the paper detection sensors;

signal storing means for storing previous signal statuses just before current signal statuses of the output signals of the paper detection sensors;

a display section for displaying one of the paper jam removal zones for removing the paper jam; and display controlling means for identifying the one of the paper jam removal zones based on a combination of the current signal statuses obtained from the paper detection sensors and the previous signal statuses stored in the signal storing means when paper jam is detected by the paper jam detecting means and displaying the identified paper jam removal zone on the display section.

2. The paper conveying device as claimed in claim 1, wherein the paper jam removal zones are two paper jam removal zones, the paper detection sensors are two paper detection sensors, and if the presence of paper is detected by both the two paper detection sensors at the point of time when paper jam is detected by the paper jam detecting means, then the display controlling means displays, on the display section, the paper jam removal zone provided with the paper detection sensor that has the previous signal status indicating the absence of paper.

3. The paper conveying device as claimed in claim 1, wherein the paper jam removal zones are two paper jam removal zones, the paper detection sensors are two paper detection sensors, the conveyance path includes a curved portion only in one of the two paper jam removal zones, and if the presence of paper is detected only by the paper detection sensor in the other of the two paper jam removal zones at the point of time when paper jam is detected by the paper jam detecting means, then the display controlling means displays the one of the two paper jam removal zones on the display section if the paper detection sensor in the one of the two paper jam removal zones has the previous signal status indicating the presence of paper, or displays the other of the two paper jam removal zones on the display section if the paper detection sensor in the one of the two paper jam removal zones has the previous signal status indicating the absence of paper.

* * * * *